US005501133A

United States Patent [19]

Brookstein et al.

[11] Patent Number: 5,501,133

[45] Date of Patent: Mar. 26, 1996

[54] APPARATUS FOR MAKING A BRAID STRUCTURE

[75] Inventors: David Brookstein, Wellesley; Donald Rose, Sharon; Robin Dent; John Dent, both of Foxboro; John Skelton, Sharon, all of Mass.

[73] Assignee: Albany International Corp., Albany, N.Y.

[21] Appl. No.: 248,577

[22] Filed: May 24, 1994

Related U.S. Application Data

[63] Continuation of Ser. No. 73,882, Jun. 9, 1993, abandoned, which is a continuation of Ser. No. 681,330, Apr. 5, 1991, abandoned, which is a division of Ser. No. 501,043, Mar. 29, 1990, abandoned.

[51] Int. Cl.[6] ..... D04C 3/06

[52] U.S. Cl. ..... 87/33; 87/50

[58] Field of Search ..... 87/29, 30, 33–51

[56] References Cited

U.S. PATENT DOCUMENTS

| | | | |
|---|---|---|---|
| 165,941 | 7/1875 | Malhere | 87/42 |
| 470,800 | 3/1892 | Cobb | 87/35 |
| 886,825 | 5/1908 | Lepperhoff | 87/37 |
| 936,356 | 10/1909 | Rahm | 87/37 |
| 1,104,777 | 7/1914 | Cobb . | |
| 1,104,778 | 7/1914 | Cobb . | |
| 2,018,596 | 10/1935 | Blaidsdell . | |
| 3,426,804 | 2/1969 | Bluck . | |
| 4,312,261 | 1/1982 | Florentine . | |
| 4,615,256 | 10/1986 | Fukuta . | |
| 5,067,525 | 11/1991 | Tsuzuki et al. | 87/33 |

FOREIGN PATENT DOCUMENTS

| | | | |
|---|---|---|---|
| 113196 | 7/1984 | European Pat. Off. . | |
| 243119 | 10/1987 | European Pat. Off. . | |
| 828062 | 5/1938 | France | 87/50 |
| 405241 | 10/1924 | Germany . | |
| 17621 | of 1908 | United Kingdom | 87/29 |
| 264149 | 7/1927 | United Kingdom | 87/51 |
| 724604 | 2/1955 | United Kingdom . | |

*Primary Examiner*—Joseph J. Hail, III

*Attorney, Agent, or Firm*—Kane, Dalsimer, Sullivan, Kurucz, Levy, Eisele and Richard

[57] ABSTRACT

The invention concerns a braid structure comprising a plurality of braided layers of stranded material in which the layers are laid down in a single pass of a braiding machine, with at least one strand of each layer extending into a contiguous layer to form an interlock between the layers. The invention also concerns a machine and a method of making the structure by supplying groups of strands, (R, B, G, O, W), to a braid forming station, whereby each group of strands forms a braid layer. A strand (R) from one of the groups passes into or through the strands (B) of a group of an adjacent layer to form an interlock therebetween.

13 Claims, 6 Drawing Sheets

APPARATUS FOR MAKING A BRAID STRUCTURE

This application is a continuation of application Ser. No. 08/073,882, filed Jun. 9, 1993, now abandoned, which is a continuation of application Ser. No. 07/681,330, filed Apr. 5, 1991, now abandoned, which is a divisional of application Ser. No. 07/501,043, filed Mar. 29, 1990, now abandoned.

BACKGROUND OF THE INVENTION

This invention is concerned with the production of a braid structure which has a plurality of layers of stranded material which are laid down in the form of a hollow structure. Multi-layer braided material is made conventionally by forming a first layer of braid and then sequentially forming further layers over the original layer. Braids are currently produced using a "maypole" type of braider where an annular bedplate has a serpentine path formed by a pair of intersecting, serpentine tracks formed in it and movable package carriers adapted to travel along the tracks, each carrier carrying a package of stranded material which material forms the braid crossing the strands thereof from the various package carriers over each other at the intersections of the serpentine paths. The braid can be reinforced by having further "static" strands supplied from static carriers, i.e. carriers which are fixed in their location to the serpentine paths. Such a "static" strand is incorporated within the resultant braid structure to form a longitudinal strand. The braid is usually formed generally centrally of the bedplate and usually on its longitudinal axis.

To form a multi-layer braid, a series of maypole braiders may be set up with a common longitudinal axis and the braid as formed is passed serially through successive braiders so that separate layers are laid down one upon another. Alternatively, such a multilayer braid may be passed the requisite number of times through a single braider to build up the required number of layers. The braid thus formed can have any number of layers depending on the number of maypole braiders employed or the number of passes made as the case may be.

Multi-layer braid structures may be formed on a mandrel of a suitable shape, which mandrel can be removed subsequent to the formation of the structure, to result in the formation of a shaped, braid structure.

As an alternative to the maypole type of braider, it has been proposed to form a hollow braid in braiding machines of a tubular type such as is described, for example, in U.S. Pat. Nos. 4,621,560 and 4,753,150 assigned to Atlantic Research Corporation. In the machine disclosed in these patents the internal surface of a cylinder constituting the apparatus is composed of a plurality of ring members, each of a similar size which are axially arranged with respect to each other and each having a yarn carrier which can be moved axially of the cylinder. The ring members are adapted for rotation about the axis of the cylinder and the carriers are moved axially to interbraid the filaments. Stops are provided to limit and control the amount of axial movement. These machines, however, operate by discontinuous or integer motion of the members and carriers and in consequence are slow in operation. This in turn limits for practical purposes the uses to which such machines can be put and hence the nature and type of braided structures which can be produced.

A major problem of multilayer braids of the type described above is the tendency for the resultant braid to delaminate in service. Such braid structures are used in so-called "composites" formed, for example by impregnating such a braid structure with a resin material. While such a composite exhibits good mechanical properties in terms of tensile strength and tensile modulus in the plane of the layer, the mechanical properties of the composite transverse to the layer rely only on the shear strength of the matrix material and the bond strength between the matrix material and the fiber layer, since this is all that physically unites adjacent layers in the structure. Thus, when the composites are subjected to transverse loads there is a risk of inter-lamina failure between the layers of the braid.

Proposals have previously been made to overcome the de-lamination problem by introducing additional strands of material which extend transversly of the layers, during the braiding process. Some of these strands have been introduced randomly, whilst others have been introduced on a systematic radial basis by providing a mandrel which has apertures through which radial strands project. Such radial strands impart a degree of coherence between the braid layers, but their presence makes it difficult to interbraid the various strands from the package carriers and as a result the rate of formation of the braid slows down.

Another attempt to overcome the problems of delamination has been by introducing strands in a stitching operation which will unite and reinforce the layers of braid. This, although partially successful, does not give the level of strength or consistency which is required in many applications of such braid structures or of the composites formed therefrom.

In order to have an effective braid structure it is desirable for the various layers of the braid to be positively interlocked.

SUMMARY OF THE INVENTION

The present invention provides a multilayer braid structure in which the layers are interbraided and which exhibits substantially uniform or predetermined properties. The invention also sets out to provide an improved form of braid structure which can be used also as a basis for a braided composite which is able to be constructed cheaply and swiftly and thus is economical in its manufacture.

According to the present invention there is provided a braid structure comprising a plurality of layers of stranded material in which the layers are laid down in a single pass of a braiding machine and in which in each layer at least one strand of that layer extends into a contiguous layer to form an interlock between the layers.

As used herein, the term "strand" is to be understood to include filaments, monofilaments, slit tape, rovings, multifilament yarn, braids or other longitudinal textile products.

The interlock between the layers may be a direct interlock in which the interlocking strand passes from a first layer to a contiguous second layer, and passes around at least one strand in the second layer.

Alternatively the interlock between the layers may be an indirect interlock in which an interlocking strand passes from the first layer through the second layer to another, not necessarily contiguous layer in the structure, and passes around a strand in the other layer to serve to bind the first layer and the other layer together and at the same time to bind the layers therebetween.

The braid structure in accordance with the present invention may be hollow and may be of a circular or of an irregular cross-section. In a further aspect of the invention the braid is a collapsed braid.

The invention includes a composite material comprising a braid structure in accordance with the invention having a matrix of resin material dispersed and/or distributed within the interstices of the braid. In another aspect of the invention, there is provided a composite material comprising a braid structure having a plurality of layers of stranded material in which the layers are laid down in a single pass of a braiding machine and in which in each layer at least one strand of that layer extends into a contiguous layer to form an interlock between the layers, and a matrix material incorporated at least in the interstices of the braid structure. At least some of the strands may comprise a resin compatible with the matrix material. Such strands may be preimpregnated. The preimpregnation may be by coating the strands with a resin layer or coating. Alternatively, the strands may include or comprise the resin material.

After formation of the braid, it may, with or without a matrix material be subjected to a treatment in which the resin material component of the strand may permeate the interstices of the braid structure.

The matrix material of the braid composite may be either a thermoplastic or a thermosetting resin. The composite after formation, may subsequently be subjected to shaping, for example, by the application of heat and pressure in a mould.

In another aspect of the present invention, there is provided a method of making a multilayer braid structure which method comprises supplying groups of strands to a braid forming station whereby each group of strands forms a braid layer thereat in which a strand from one of the groups passes into or through the group of an adjacent layer to form an interlock therebetween.

The present invention also provides a method of making a multi-layer braid structure which method comprises:

(i) feeding a plurality of strands of material from a first set of movable package carriers to a braid-forming area to form a braid layer thereat in which each movable package carrier traverses a predetermined first serpentine path.

(ii) feeding a plurality of strands from a second set of movable package carriers to the braid-forming area to form a braid layer thereat in which each movable package carrier of the second set traverses a predetermined second serpentine path, wherein each of the serpentine paths is arranged so that at least one package carrier of each set can carry a strand of material from its respective layer into the other layer to interlock with the other layer.

In one aspect of the present invention the second layer may be contiguous to the first layer, whereas in an alternative embodiment of the invention the second layer may be spaced from said first layer and have a number of intermediate layers interposed therebetween. In these circumstances a strand associated with the package carrier moving between the first and the second layers is caused to pass through all the intermediate layers prior to forming a positive interlock with the second layer.

Strands of material from "static" package carriers may also be fed to the braid forming area in respect of each layer for interbraiding with the strands from the respective movable package carriers.

A mandrel may be positioned at the braid-forming area in order to form a hollow braid structure and the first layer of the braid is then formed on the mandrel and second, and subsequent layers are formed over the first layer. The mandrel, which may be of circular or other cross section, may be moved through the braid-forming area as braiding takes place to build up a continuous hollow braid structure.

The method also includes the step of laying down all the layers of the multi- layer braid structure in one pass of the braiding machine.

The invention further encompasses a method of making a braid structure having a plurality of layers, each layer being constituted by interbraided strands of material, with at least one strand of each layer interlocking with strands of a contiguous layer and includes in respect of each layer the steps of feeding to a braid-forming area a plurality of strands of material from a plurality of static package carriers and interbraiding the static strands with further strands from a corresponding set of movable package carriers. Each movable package carrier when traversing with respect to its associated layer along a predetermined serpentine path, interbraids the strands of the movable package carriers of a respective layer with the strands of the set of static package carriers of the respective layer to form the braided layer. By feeding strands of each layer simultaneously to the braid-forming area, the layers are overlaid one on the other, and arranging each serpentine path so that at least one movable package carrier of each set carries the strand of material from its respective layer, into another layer interlocks with strands of another layer.

In one embodiment, at least one movable package carrier returns the strand to its originating layer. In another embodiment, the serpentine path of the movable package carriers of an intermediate layer may move from the intermediate layer to carry a strand of material from that layer into both contiguous layers and returns to the intermediate layer to interlock the strands of the intermediate layer with each contiguous layer.

Where the braid structure to be manufactured includes a plurality of intermediate layers, a movable package carrier may traverse from one serpentine path to a next adjacent serpentine path to carry a movable strand from a layer associated with the package carrier into layers beyond the immediate contiguous layers and to return the package carrier to the original serpentine path, thereby interlocking the layers through which the strand from the movable package carrier has passed.

The braid structure may be of hollow form and may be formed over a mandrel, which can be positioned at the braid-forming area. Typically, the mandrel moves through the braid-forming area as braiding takes place to build up a continuous hollow braid structure thereon with all the layers of the braid structure being interlocked.

The invention further provides a method of making a braid structure having a plurality of layers of strand material, each layer being constituted by interbraided strands of material with at least one strand of each layer interlocking with or passing through strands of a contiguous layer. The plurality of package carriers and serpentine paths are arranged on the internal surface of a tubular braiding machine, the internal surface having a plurality of serpentine paths formed therein. A plurality of "static" strands of material are fed to a braid-forming area from a first set of static package carriers, whereby the "static" strands are interbraided with further strands from a corresponding set of movable package carriers. Each movable package carrier traverses a predetermined first serpentine path to interbraid the strands of the first set of movable package carriers with the strands from the first set of static package carriers to form a first braided layer strands from a second set of static package carriers are fed simultaneously to the braid-forming area, for interbraiding with strands from a corresponding second set of movable package carriers. Each movable package carrier of the second set traverses a predetermined second serpentine path, which interbraids the strands from the second set of movable package carriers with the strands from the second set of static package carriers, to form a second braided layer on the first braided layer. Each serpentine path is arranged so that at least one movable package carrier of each set of movable package carriers carries a strand of material from its respective layer, into a contiguous layer to interlock with the contiguous layer before returning the strand to its own originating layer.

The braid forming area is preferably situated at the longitudinal axis of the tubular braiding machine and, as the braid structure is formed it is moved through the tubular braiding machine along the longitudinal axis thereof.

The tubular bed of the tubular braiding machine may be of circular cross-section or may be ellipsoidal or any other closed or multi-sided shape.

The invention also includes a braiding machine for forming a multi-layer hollow braid which machine comprises:

means for supplying groups of strands of material to a braiding station to form a layer of braid at the station associated with each group of strands, and means, effective during braiding, to cause or allow a strand from one layer of braid to pass into or through a next adjacent layer to form an interlock between the layers.

The invention further includes a machine for forming a multi-layer hollow braid in accordance with the invention. The braid structure has a plurality of layers each constituted by interbraided strands of material with at least one strand of each layer interlocking with the strands of a contiguous layer. The machine comprises a hollow tubular member, two apertured end plates securing the hollow cylindrical member between them, a plurality of serpentine paths circumferentially formed on the inner surface of the tubular member, a plurality of intermeshing horn gears, a plurality of movable package carriers, each arranged for movement over a serpentine path in a sequence predetermined by rotation of the horngears, and changeover track means effective between adjacent serpentine paths for the movement of a movable package carrier from one circumferential serpentine path into the adjacent serpentine path.

This movement preferably occurs at least once during a single passage of the package carrier around the tubular member.

The machine may include a serpentine path disposed adjacent each end plate and an intermediate serpentine path in which a movable package carrier in the intermediate path is transferred by the horngears to travel into the serpentine path of each contiguous serpentine path at least once during a single passage of the package carrier around the tubular member.

The tubular member may be circular, ellipsoidal or multi-faceted in cross-section. The machine may further include a plurality of intermediate serpentine paths in which a movable package carrier in at least one of the intermediate paths is transferred by horngears to travel into a plurality of said serpentine paths during a single passage of the package carrier around the tubular member.

Each sepentine path is defined by a pair of intersecting zig-zag or generally sinusoidal tracks disposed in the base plate in which the part is located. Each pair of tracks between adjacent intersections effectively defines a generally lemon shaped island portion. The movable package carriers are mounted for sliding movement along in the tracks and are driven by the horngears disposed thereunder, the arrangement being such that the array of horngears disposed beneath the serpentine tracks serves to drive the package carrier in contrary directions in each track. Thus, at any one crossover point the horngears will serve to drive a package carrier in a first direction across an intersection and subsequently a second package carrier across the same intersection in an approximately orthogonal direction.

This arrangement is well known in a standard braiding machine and movable package carriers in such a machine are restricted to movement solely in the single track of the serpentine path pair within which it is located. In accordance with the present invention, two or more serpentine paths are arranged in juxtaposition to provide an array of island portions extending as columns generally across the direction of movement of package carriers in each track. Thus, all the islands in a first serpentine path would be in register with all the islands of the second and subsequent serpentine paths to form columns extending substantially normal to the line of the serpentine track. In accordance with the present invention at intervals between two adjacent paths, islands are modified to define part of a crossover track between the adjacent serpentine paths.

The horngears are arranged under the serpentine paths to provide an array of gears with basically one gear arranged under each island. Thus, while gears along each serpentine path intermesh at the crossover points to effect a changeover point between the intersecting tracks of the path, the gears between adjacent paths also intersect, not only along the path lengths, but laterally along the columns. Thus, at the changeover point between the adjacent paths there is a positive drive between the horngears disposed therebeneath and the package carrier can move smoothly between one serpentine path to the next via the crossover tracks which feed from one path into an adjacent path, thus permitting a package carrier to move from one path to an adjacent path and carrying the yarn with it, thereby effecting movement of the strand from one layer to a next adjacent layer. It will be appreciated that a variety of different interlocking patterns can be produced between adjacent layers in this way.

The dimensions between each island portion and the dimensions between each crossover point in a given serpentine path remain substantially constant. A pair of standard adjacent island portions in contiguous serpentine paths may be exchanged for a pair of modified islands which define part of the crossover track between them. Since island portions are readily interchangable, it will be appreciated by one skilled in the art that a large variety of patterns and changeover arrangements are possible.

In a further aspect of the present invention the apparatus comprises a tubular and preferably substantially cylindrical body member adapted to carry about its surface a plurality of intermeshing horngears. Each horngear is in direct meshing relationship with the next horngear in a given path, but horngears within a given path (or row) may intermesh at an angle with respect to the other.

The internal surface of the cylindrical bedplate may be provided with a plurality of track forming elements or track plates comprising standard track forming elements, each of which define the extremity of a track portion of a serpentine path, each element being curved to correspond with the curvature of the bedplate. External track forming elements may serve to define either standard elements which in juxtaposition produce a standard serpentine path without crossover points or may be modified to provide a crossover section.

The intermeshing horngears are mounted externally of the cylindrical bedplate. The drive means for the gears may be mounted on one of the end plates. The drive means may include principal driving gears mounted on one of the end plates and disposed at 90° with respect to each other and these may be driven by a single prime mover. Coupling means may be provided between the drive gears on each end plate.

In addition to the movable package carriers described above, fixed or "static" package carriers may also be provided such that they introduce strands at points on the surface of the cylindrical member. In accordance with one aspect of the present invention, such "static" package carriers may be arranged to provide a strand of braidable material to the braid area or station of a braiding machine via hollow axles of each of the horngears.

Machines in accordance with the present invention can produce either a collapsed or a hollow form of braided structure. Where a hollow form or structure is produced, the machine may include a mandrel movable longitudinally along the central axis of the cylindrical member. In this case, strands from the movable package carriers may be fed to the movable mandrel to form a braid structure thereupon.

It will be appreciated from the foregoing that the flexibility of the structure in accordance with the present invention permits a large variety of different braid structures to be produced. The invention includes the braiding or interbraiding of different types of strands. Laminated braid layers may be formed with an interlocked configuration by providing each principal layer of the braid structure with strands of braidable material of one set of properties and adjacent braid layers being formed of strands of material of different properties, while at the same time allowing a predetermined degree of interbraiding between the layers.

Following is a description by way of example only and with reference to the accompanying drawings of methods of carrying the invention into effect.

BRIEF DESCRIPTION OF THE DRAWINGS

FIG. 9 is a perspective view of the braided structure and illustrates the serpentine paths, strands and carriers.

FIG. 10 is a perspective view of the braided structure, strands and carrier.

DESCRIPTION OF THE PREFERRED EMBODIMENTS

Figure 1:
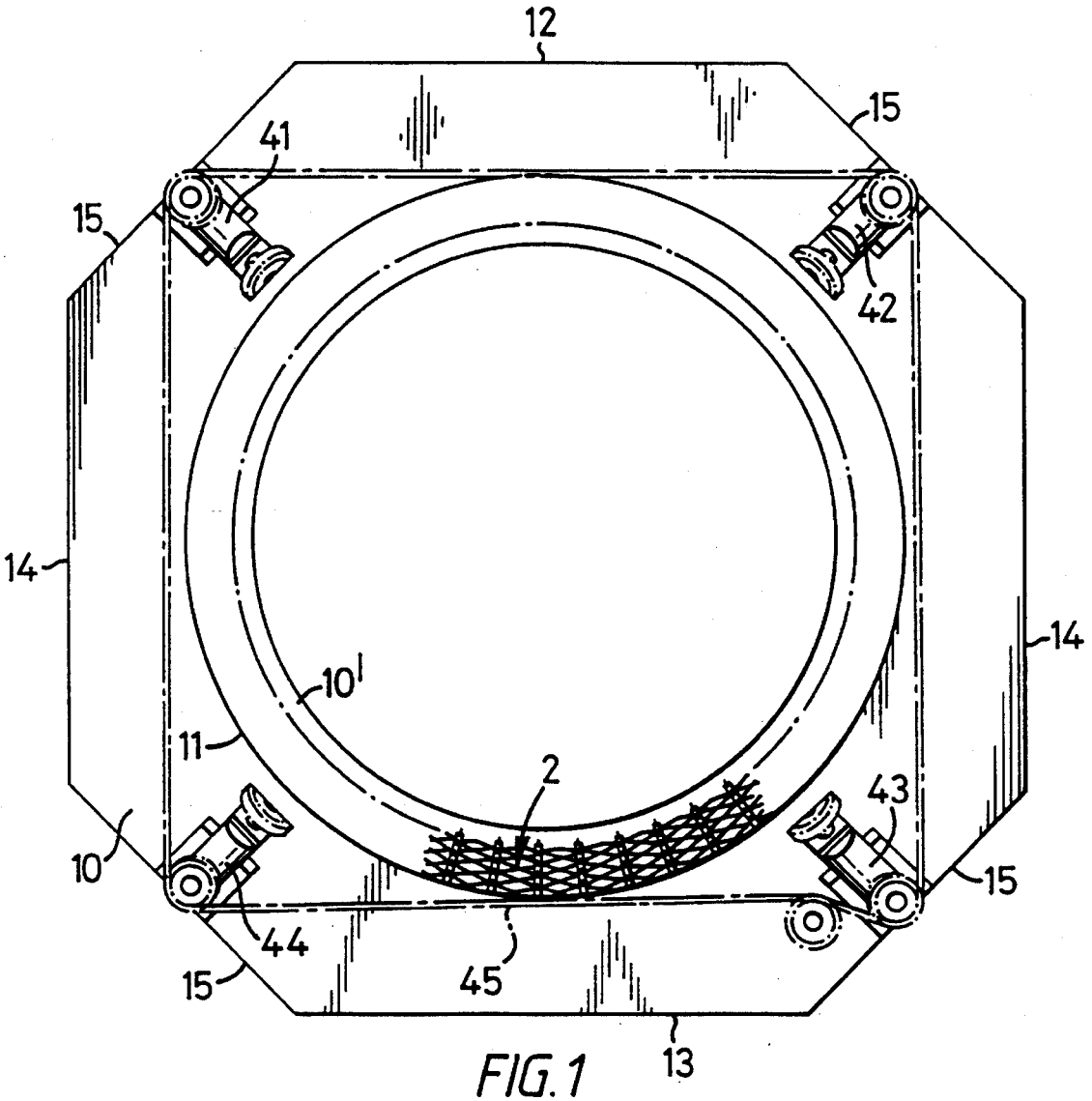
FIG. 1 is a front view of braiding machine in accordance with the invention for producing a hollow braid structure.
Figure 2:
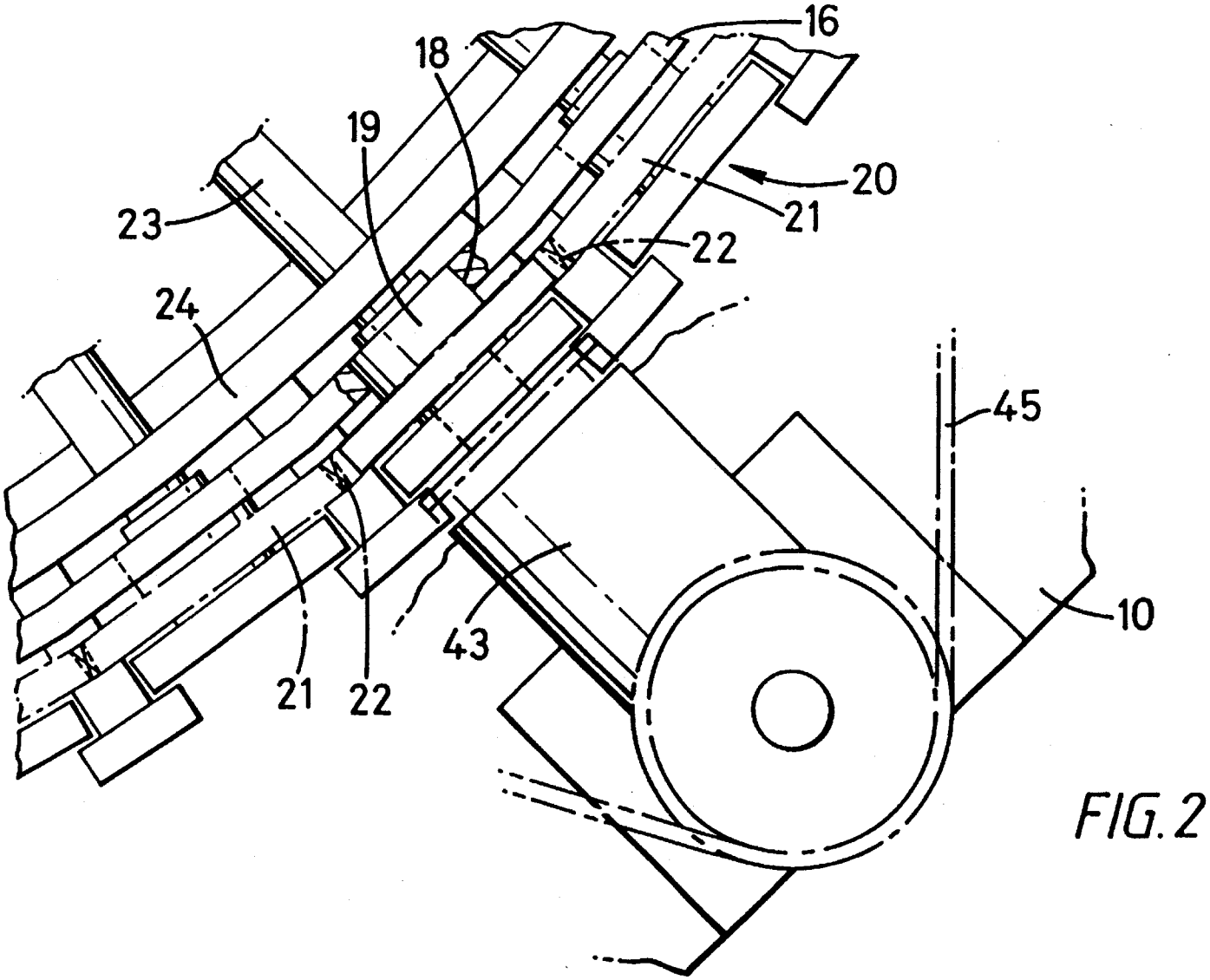
FIG. 2 is an enlargement of FIG. 1 showing the drive arrangement therefor.

The machine illustrated in the drawings comprises a pair of end plates 10, 10' each plate having a substantially circular opening 11, a top edge 12, a bottom edge 13 and a pair of side edges 14. Each corner is provided with a chamfered portion 15 which together with the top edge and side edges defines a generally eight sided periphery for each end plate 10, 10'.

Each end plate 10 is secured to a generally cylindrical bedplate 16 formed of a plurality, in the specific example, forty eight of flat elements, each interconnected one to the other, so that each flat element is disposed at an angle of 7.5° to its neighbor. Each flat element comprises a central bore 18 which receives and retains a shaft bearing 19 of a horngear 20. Each horngear 20 has a peripheral tooth portion 21 which is adapted to mesh at 22 with the corresponding tooth portion of each adjacent gear in the circumferential array. In this example, each horngear 20 has two orthogonal diametric slots in the surface thereof which is disposed towards the center of the machine.

Each shaft bearing 19 carries a drive shaft for driving a respective horngear 20. Each horngear 20 is journalled for rotation about a hollow tube 23 which latter serves to support island plates 27 or 28, (see FIG. 4).

A plurality of horngears 20 is arranged about the circumference of bedplate 16 to provide a plurality, in the case of the specific example in the drawings, forty eight linear columns of horngears, each column extending longitudinally of the cylindrical bedplate 16, the arrangement being such that the intermeshing gears within each columm lie within a plane.

Each column comprises five horngears which when considered circumferentially constitute five circumferentially disposed rows of horngears, each row comprising forty eight gears. Each circumferential row corresponds to a serpentine path extending circumferentially of the cylindrical bedplate 16 the arrangement being such that the horngears of the array intermesh one with respect to another. Each horngear in an intermediate row meshes with four other gears, i.e. two gears in its own row and a gear from each adjacent row. Each horngear in an edge row meshes with three adjacent gears, i.e. the two adjacent gears in its own row and the adjacent gear in the next intermediate row. This is best seen from FIG. 3 in which horngears 31, 32, 33, 34 and 35 intermesh one with respect to another in a plane and the gears 31, 32, 33, 34 and 35 together constitute one column of the forty eight.

Figure 4:
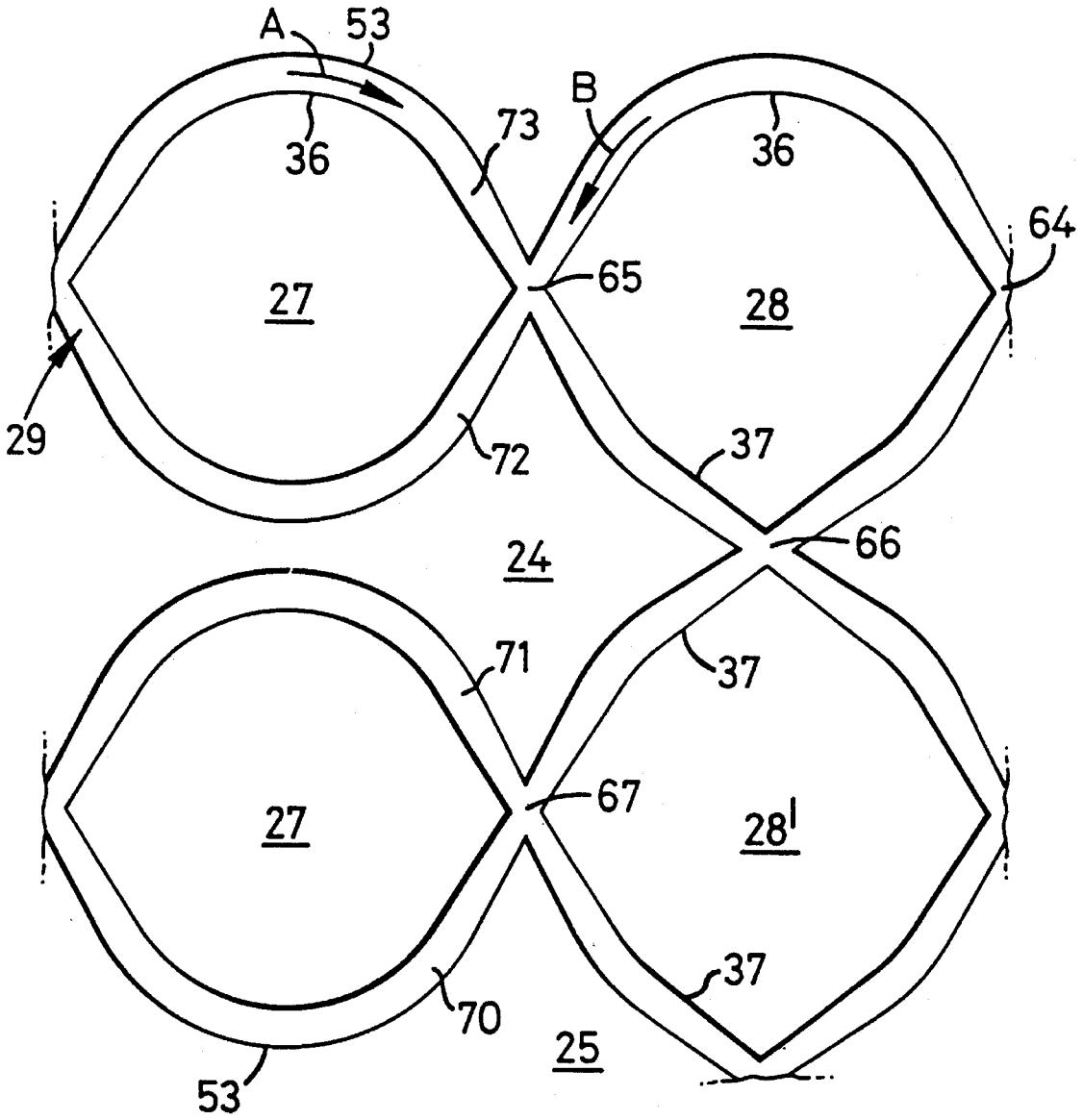
FIG. 4 is an enlargement of the internal surface of the machine indicating a general layout of the serpentine tracks.
Figure 7:
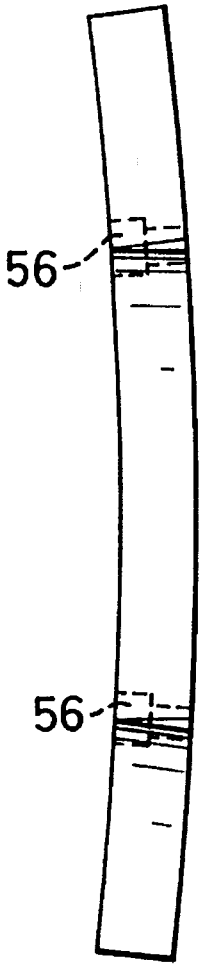
FIG. 7 is a side view of FIG. 6 indicating the curvature of the plate.
Figure 5:
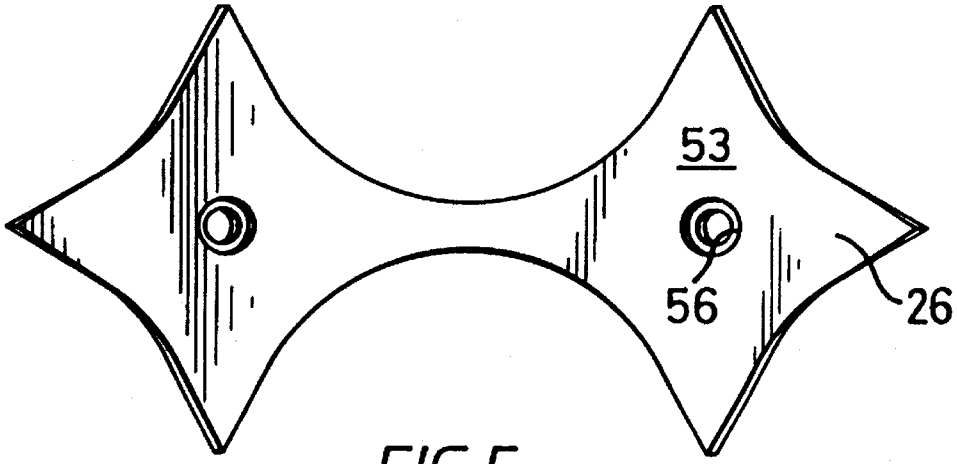
FIG. 5 is a typical intermediate track plate.
Figure 6:
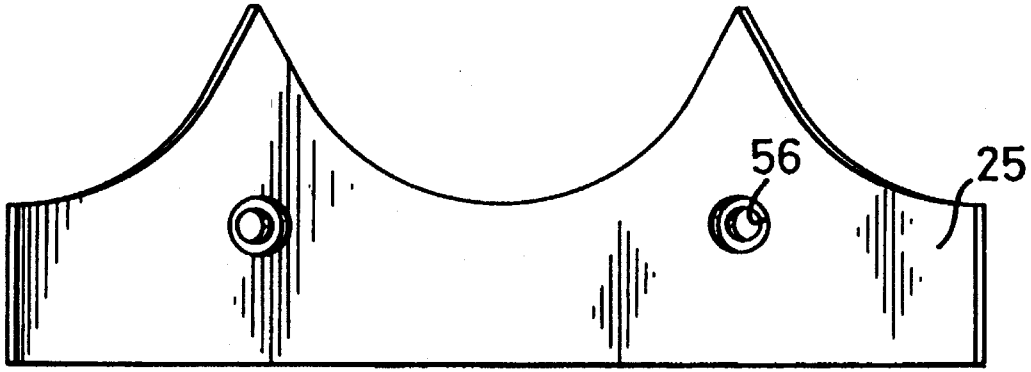
FIG. 6 is a typical end track plate.

Referring now to FIG. 4, it will be appreciated that each serpentine path comprises a pair of intersecting tracks. Thus, the first serpentine path 29 comprises generally sinusoidal path tracks 72 and 73. The tracks are defined by outer plate 25 which has a contoured track edge 53 which serves to define the outer edge 53 of track 73. Inner edge 36 of the track is defined by guide plate 27 which is a standard island plate having a generally lemon-shaped configuration. It will be seen that the tracks 73 and 72 intersect at 65 and the arrangement is such that a strand package carrier (not shown) moving in direction of arrow A passes along path 73 and crosses over intersection 65 and is then followed in time by a yarn package carrier moving in the direction of arrow B in the opposite sense. Thus, it would be appreciated that in the standard serpentine path formed solely of island plates 27, the crossovers 64, 65 all lie within the same row. Guide plate 28, however, is an island crossover plate; it has one edge 36 contoured to correspond with edge 36 of island plate 27, while the other edge 37 is contoured to define a crossover 66 together with the intermediate track plate 26 and corresponding island plate 28'. It will be noted that island plate 28' is provided with two crossover edges 37 to provide systematic crossover along a column.

It will be appreciated that the plates 27, 28 and 28' are selectively interchangeable, together with plates 25, 26 and other variants thereof to enable a complete interlocking matrix, or array of interlocks either along columns or between rows, or to provide interlocks between adjacent layers, or alternatively to provide interlocks passing through an intermediate layer to provide the positive interlock on the next adjacent layer.

Four drive units 41, 42, 43 and 44 (FIG. 1) are situated in the corners of drive plate 10 and these are coupled together by means of a continuous chain 45. The chain 45 is driven by a suitable prime mover, such for example, an electric or pneumatic motor.

Figure 3:
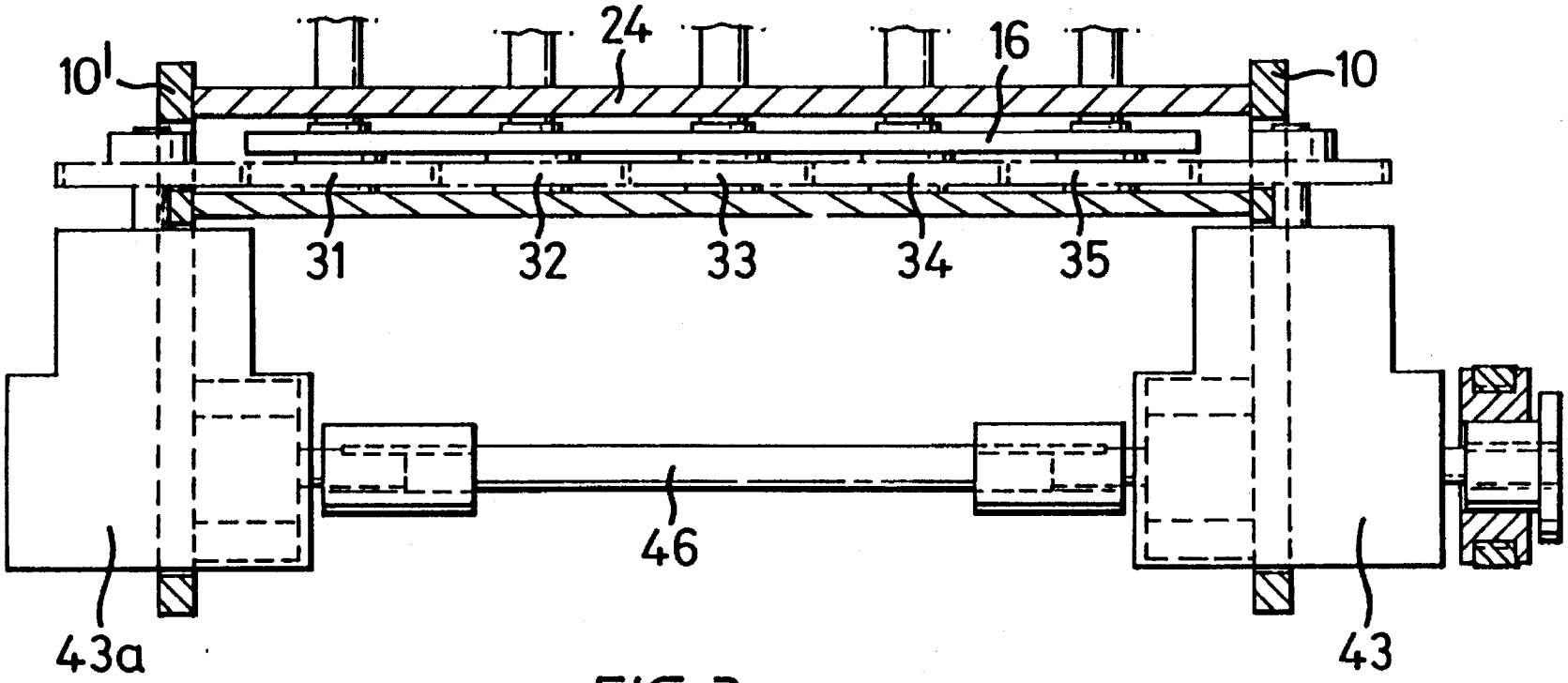
FIG. 3 is a longitudinal cross-sectional view of the machine showing the lay out of the gearing.

In order to distribute the load on the array of horngears, corresponding drive units 41*a*, 42*a*, 43*a* and 44*a* are provided on the other end plate 10' of which only one 43*a* is shown in FIG. 3. These drive units are interconnected by means of a shaft 46 which serves to ensure that all the drives and horngears are synchronised by providing positive drive at eight points through the gear array so that the applied torque on individual gears is reduced.

Each serpentine path track is adapted to contain a plurality of package carriers. Each package carrier has a depending lug which is engaged by slots in each of the horngears and as each of the gears rotates the slots co-act with the lug to drive the package around the track. The track plates 25, 26, 27 28 and 28' serve to constrain the movement of the carriers to a given track and the carriers will be retained in a given track of that path passing sequentially over crossovers with the other track of same path. When the package carrier enters a track portion of a serpentine path giving a column crossover to an adjacent serpentine path, crossover will be effected by means of a crossover such as crossover 66 in FIG. 4 to the next adjacent path.

It will be appreciated that the movement of the package carrier can be controlled so as to direct the carrier along one given serpentine path or to transfer it between adjacent paths, depending on the layout of the track plates for any particular design of braid construction. Referring to FIGS. 9 and 10, in use a series of movable package carriers 54A–54E, for example, are mounted on the five serpentine paths or rows 29A–29E of the machine and the strands 55A–55E from each carrier are lead to a central mandrel 56 which extends longitudinally of the axis of the machine. The strands 55A–55E are secured to the mandrel together with the strands from any "static" package carriers which may extend through tubes 23.

When all the strands 55A–55E have been secured to the mandrel the drive means is started which serves to rotate the horn gears 31–35 to cause movement of the movable package carriers 54A–54E along the serpentine paths in the manner described above. The design of the paths 29A–29E is such that braidable strands of material from various carriers move between the layers defined by each path to form an interlocked braid structure 57. The braid structure 57 so formed thus has multiple layers which constitute a three-dimensional braid having strands passing from layer to layer thus increasing the strength of the structure against delamination. Since carriers 54A–54E are moving in all five rows of all forty eight columns simultaneously, the braid structure 57 is continuously laid down as a three dimensional braid with all the layers interlocked.

Figure 8:
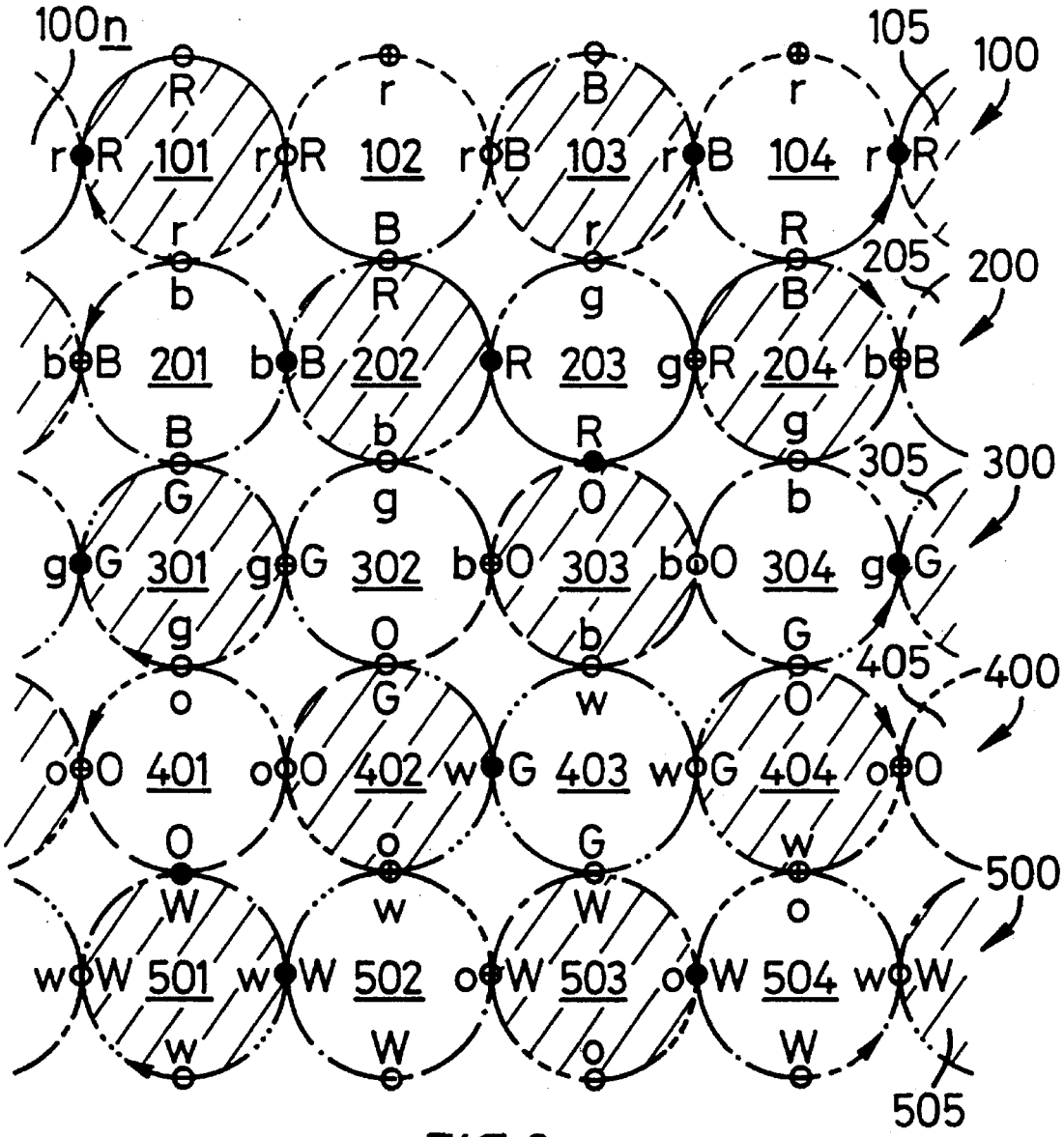
FIG. 8 is a schematic diagram showing part of a typical layout of horngears and illustrating the serpentine tracks for enabling the invention to be effective.

This is further illustrated in FIG. 8 of the accompanying drawings which shows five rows of gears 100, 200, 300, 400 and 500 each row having forty eight gears disposed around the circumference of the machine. Corresponding gears in adjacent rows namely, 101, 201, 301, 401 and 501 each together define a column. Thus, the machine comprises five circumferential rows each containing forty eight gears or forty eight columns each containing five gears, a total of two hundred and forty gears in all. In FIG. 8 common gears in a row are prefixed by the first digit, common gears within a column are prefixed by the third digit.

Columns of gears may be arranged in sets and in the particular embodiment shown in FIG. 8, the columns 101 to 501, 102 to 502, 103 to 503, 104 to 504 constitute a single set. The column 105 to 505 and so on constitute the next adjacent set. Hence in the specific example of which there are five rows of forty eight columns, there are twelve sets of gears in the total array of two hundred and forty gears.

In FIG. 8, the horngears which rotate in a clockwise direction are indicated by shading and the gears which rotate in a counter clockwise direction are those which have no shading. Thus, each gear will rotate in a contrary direction to its neighbors meshed with it. Slots in the horngears are indicated diagrammatically by circles on the periphery of the gear and it is these slots which at any time are occupied by a movable package carrier.

Turning now to the first column of horngears 101 to 501, if we consider the horngear at R carrying a red strand, we see from the solid small circle that this is positioned at the far left hand position of gear 101 as seen in FIG. 8; as 101 rotates the package carrier will be carried generally clockwise through 180° to the crossover point with the next gear 102 in the same row. Gear 102 is rotating in a counter clockwise direction and the package carrier R is thus carried by gear 102 to a crossover point between gears 102 and 202, i.e. the crossover point between adjacent rows within the same column. Continued rotation of gear 102 results in movement of the package carrier substantially clockwise thereabouts to the crossover point between gears 202 and 203, i.e. in adjacent columns, but in the same row. A crossover takes place as the package carrier is moved by gear 203 through an arc of 180° to a crossover point between gear 203 and 204, i.e. a crossover point between adjacent columns within the same row. Gear 204 rotates clockwise and carries the package carrier through an arc of 90° to a crossover point between gears 204 and 104, i.e. to effect a crossover in the same column but between different rows, where the package carrier is then rotated clockwise about gear 104 through an arc of 90° to a crossover point with gear 105 and the sequence starts once again.

Thus, it will be seen that the strands from the package carrier starting with gear 101, moves along its row 1 to column 2 and then has crossed over in column 2 from row 1 to row 2; it is then moved along row 2 via gear 203 and back to row 1 via column 4 thus completing an interlock sequence. By following the remainder of the lettered package carriers within FIG. 8 it will be seen that the same sequence is repeated but staggered, for each of the rows, thus producing a three dimensional braid structure.

In operation of the machine a mandrel is located substantially centrally of the cylindrical bedplate 16. This mandrel (not shown in the drawings) is moved generally along the longitudinal axis of the machine as the braid is built up. The mandrel may be a rigid mandrel or one that is capable of being collapsed to enable the braid to be released from the mandrel after formation. It will be appreciated by one skilled in the art that the shape of the mandrel depends on the shape of the product required, although it is normally of a circular cross section.

The braid structure produced in the manner described above may be subsequently impregnated with a matrix material such as thermoplastic or a thermosetting resin to make a durable braided composite structure. In the alternative, the strand material itself may either be impregnated by a matrix binder which may subsequently be activated or may be composed of components of matrix material. Due to the truly three dimensional structure of the resulting braid, the braid exhibits a much enhanced strength against delamination than has been experienced hitherto.

The method and apparatus of the invention has been found to be suitable for the braiding of ceramic fibers such as those of silica, glass and carbon, as well as standard textile fibres including fibres such as KEVLAR.

We claim:

1. A braiding machine for forming a multilayer braid, said machine comprising:

a braiding station;

supply means for supplying a plurality of strands of material to said braiding station to form a layer of braid at said station associated with each group of strands;

track means disposed at said braiding station defining at least a first and a second pair of serpentine paths, each pair of paths including a first and a second path, said first and second paths of each layer crossing over each other to define intralayer crossover points; and braiding means disposed at said braiding station for braiding said strands into said layers and for passing one strand from each layer of braid into a next adjacent layer to form an interlock between said layers and including a plurality of package carriers, each package carrier being arranged for movement in one of said serpentine paths and receiving a strand from said supply means; each layer being formed by at least two package carriers, each carrier moving along a respective serpentine path of one of said pairs of serpentine paths; wherein one of said serpentine paths of one layer and one of said serpentine paths of an adjacent layer are provided at preselected positions with interlayer crossover points with one carrier crossing over to said first serpentine path of said adjacent layer at said interlayer crossover points; and with one carrier of said serpentine path of said adjacent layer crossing over to said one serpentine path of said adjacent layer crossing over to said one serpentine path of said first layer at said interlayer crossover point;

wherein said first pair is axially spaced with respect to said second pair, and any two interlayer crossover points between two adjacent layers are separated by at least two intralayer crossover points.

2. The machine of claim 1 further comprising a plurality of horn gears for driving said package carriers along said paths.

3. The machine of claim 1 wherein said braiding station comprises a stationary member having an internal tubular surface and wherein said serpentine paths extend circumferentially around said tubular surface.

4. The machine of claim 3 wherein said tubular surface has a longitudinal axis along which said multilayer braid is formed, and wherein said package carriers are arranged radially with respect to said longitudinal axis.

5. A braiding machine for making a hollow braid comprising:

a support structure having a tubular surface;

a plurality of rotatable interengaged horn gears in toothed engagement;

driving means for driving said horn gears, each horn gear being arranged to rotate in a direction contrary to each interengaged horn gear;

track means overlaying said horn gears and defining at least a first pair and a second pair of serpentine paths extending circumferentially around said surface each pair including a first serpentine path and a second serpentine path, said first and second serpentine paths crossing each other at intralayer cross points, said first pair being axially spaced with respect to said second pair, said first and second pairs of paths being interconnected by interlayer crossover; points, each interlayer crossover point being separated from any other crossover point by at least two intralayer crossover points and a plurality of yarn carriers movable along said paths by said horn gears, the yarn carriers in each pair of paths cooperating to braid a yarn layer, a carrier of said first pair crossing over to said second pair and a carrier of said second pair crossing over to said first pair at one of said interlayer crossing point to interlock said yarn layers.

6. The machine of claim 5 wherein said crossover point is arranged to cause a carrier of said first pair and a carrier of said second pair to cross over once for each passage of said carrier around said tubular surface.

7. The machine of claim 5 wherein said tubular surface is circular.

8. The machine of claim 5 wherein said paths are defined by tracks.

9. The machine of claim 8 further comprising a plurality of plates having edges forming said tracks.

10. The machine of claim 9 wherein each track has an outer edge and an inner edge, and said plates include an outer plate defining said outer edges and island plates defining inner edges.

11. The machine of claim 5 wherein said driving means includes a plurality of driving units arranged around said tubular surface and drive unit coupling means for coupling said drive units, said drive units driving said horn gears.

12. The machine of claim 5 further comprising radial tubes extending toward an axis of said tubular surface and static yarns extending through said tubes, said yarn layers being braided around said static yarns.

13. The machine of claim 5 wherein a single carrier is disposed in each path at all times.

* * * * *